United States Patent [19]

Catherall

[11] Patent Number: 4,973,061

[45] Date of Patent: Nov. 27, 1990

[54] INDOOR BASEBALL GAME APPARATUS

[76] Inventor: Raymond H. Catherall, 155 Channel Highway, Taroona, Tasmania 7006, Australia

[21] Appl. No.: 122,219

[22] Filed: Nov. 18, 1987

[30] Foreign Application Priority Data

Nov. 18, 1986 [AU] Australia ..... PH9026

[51] Int. Cl.[5] ..... A63B 71/02

[52] U.S. Cl. ..... 273/411; 272/3

[58] Field of Search ..... 273/25, 26 R, 89, 90, 273/411, 95 H; 272/3; 135/90

[56] References Cited

U.S. PATENT DOCUMENTS

| | | | |
|---|---|---|---|
| 74,154 | 2/1868 | Sebring | 273/89 |
| 856,216 | 6/1907 | Black | 273/90 |
| 975,316 | 11/1910 | Barrett | 273/89 |
| 1,571,726 | 2/1926 | Krug | 273/89 |
| 4,715,598 | 12/1987 | Knight | 272/3 |
| 4,758,002 | 7/1988 | Murphy | 272/3 |

FOREIGN PATENT DOCUMENTS

| | | | |
|---|---|---|---|
| 6580 | 4/1890 | United Kingdom | 135/90 |

*Primary Examiner*—Theatrice Brown

*Attorney, Agent, or Firm*—Stevens, Davis, Miller & Mosher

[57] ABSTRACT

Apparatus for playing a game comprises a substantially enclosed court including a pitch, upstanding walls and a ceiling. The walls are demarcated into zones and the pitch has markings thereon including a batting base and at least two further bases spaced around a central area. Preferably there are four bases spaced around a diamond shaped central area. The walls and ceiling are preferably made of netting adapted to retain a baseball sized ball therein. In use a ball pitched towards a batsman standing above the batting base will be struck towards the walls and, depending on the wall zone which the ball strikes first, different points will be scored. A batsman will, after striking a ball, run, from base to base around the central area.

6 Claims, 2 Drawing Sheets

INDOOR BASEBALL GAME APPARATUS

Figure 1:
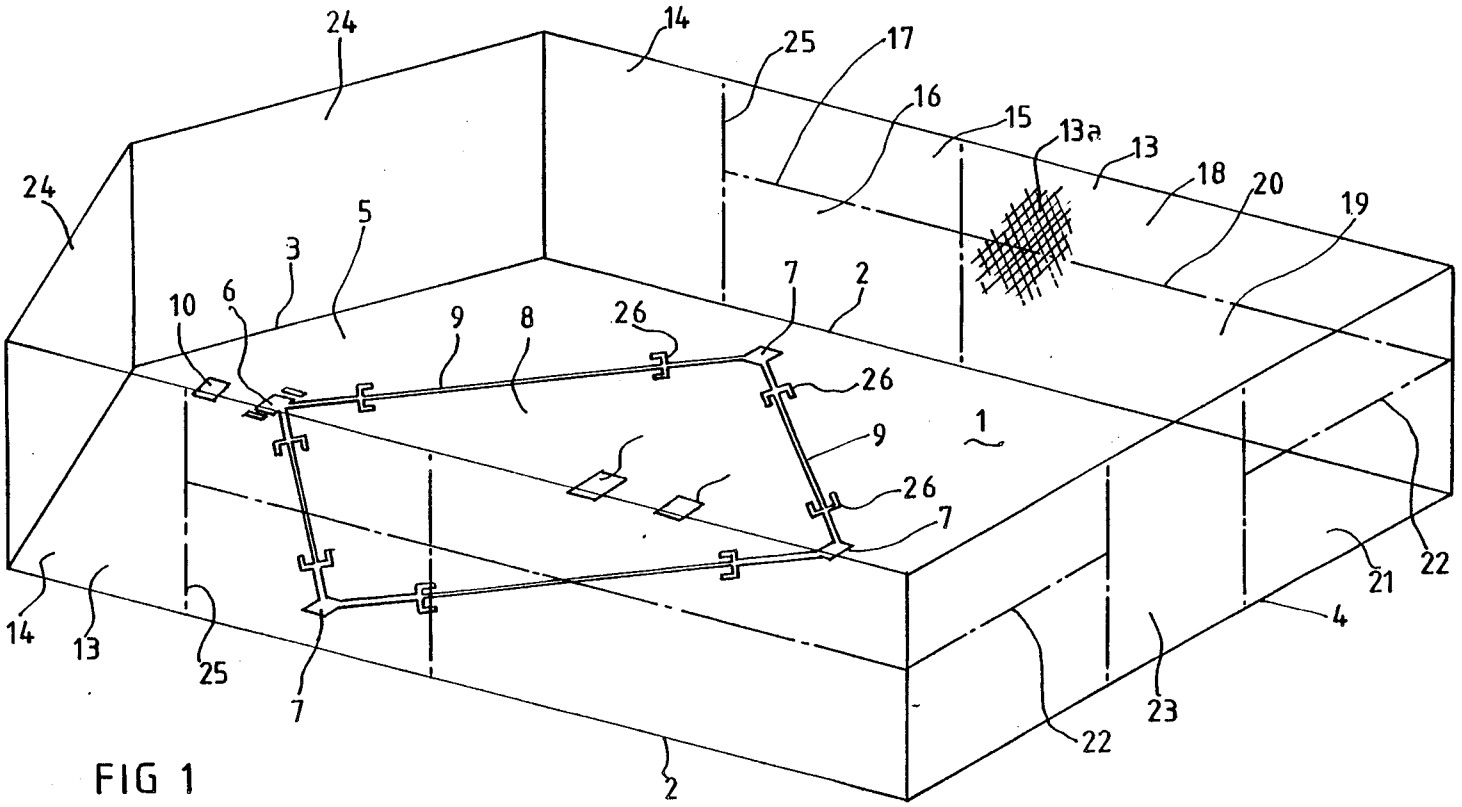

The present invention relates to apparatus for use in a game and in particular to apparatus for use in a game suitable to be played indoors.

In recent times people have shown an increased interest in indoor sports games which can be played at any time during the day or evening. For many years basketball has been played indoors and recently particular interest has been shown in tennis. However, in most cases the existing indoor facilities are not suitable for use in indoor ball games which utilise skills from well known outdoor games such as baseball, softball, rounders and the like. Accordingly, there is a need for new types of apparatus suitable for use in playing indoor games involving a bat and a ball.

It is an object of the present invention to provide apparatus suitable for use in an indoor game involving a bat and a ball.

According to the invention there is provided apparatus for playing a game comprising a substantially enclosed court including a pitch, upstanding walls around the perimeter of the pitch and a ceiling, the walls being demarcated into zones, the pitch having markings thereon said markings defining a batting base and at least two further bases, the bases being spaced around a central area.

Preferably there will be a batting base and three further bases, the central area being of diamond configuration.

The pitch markings may further depict one or more pitching plates, and there may be straight lines joining the bases around the central area. Further markings may include a catcher zone and markers intersecting the straight lines adjacent to the bases. The distance between adjacent bases on the perimeter of the central area may be between 10 m and 16 m and is preferably about 14 m. The pitching plate may be within the central area and may be located on a symmetry line dividing the central area into equal halves.

Figure 2:
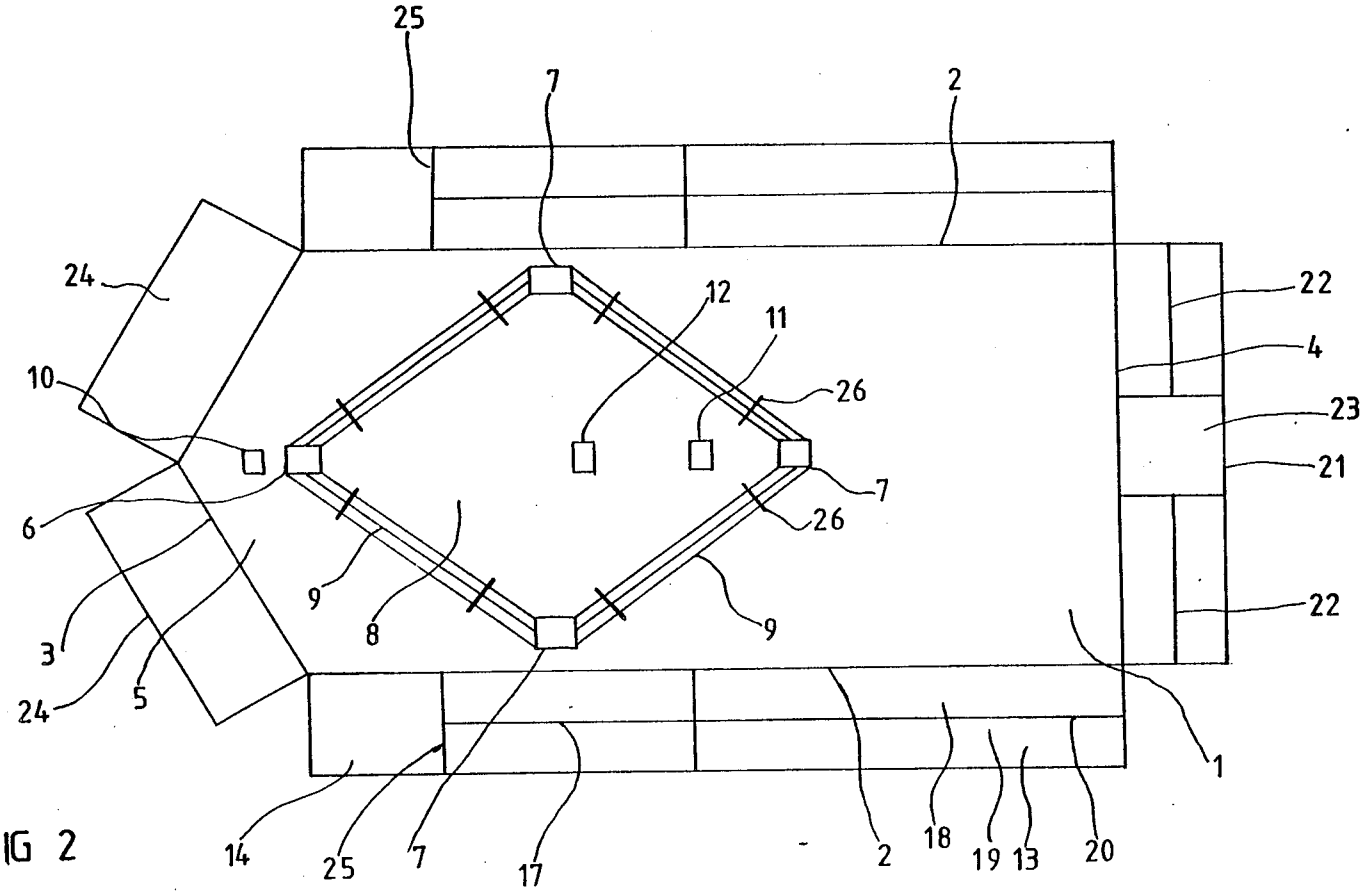

A preferred embodiment of the present invention will now be described with reference to the accompanying drawings of apparatus provided according to the invention. The particularity of this description is in no way intended to limit the generality of the foregoing. In the drawings:

FIG. 1 illustrates diagramatically in perspective view a court according to the invention, and FIG. 2 illustrates in plan view the pitch of the court of FIG. 1 together with the walls of the court laid flat adjacent their respective pitch boundaries.

The apparatus as shown in the drawings includes a pitch 1 of elongate-rectangular form having elongate sides, a batting end 3 and a home run end 4. The width of the pitch is approximately half as wide as the length thereof and the preferred form of the invention the width of the pitch is approximately 18 meters wide whilst the length is approximately 40 meters long. A pitch of different dimensions, both larger or smaller, is also envisaged. The batting end of the pitch is somewhat outwardly bowed resulting in a substantially triangular end zone 5.

The surface of the pitch may be formed from any suitable material and specifically envisaged is a synthetic grass material or a matting or carpet material. The surface of the pitch is marked with markings to enable the pitch to be used for playing a game somewhat akin to baseball. The invention will be described with particular reference to the game of baseball but it will be appreciated that other games using the apparatus as described can conveniently be played with the apparatus.

The markings on the surface of the pitch include four bases. Firstly, a batting or home base 6 is provided towards the batting end 3 of the pitch. Three other bases numbered *7a, 7b* and *7c* are spaced apart on the surface of the pitch. Two of these other bases *7a* and *7c* are located on each side of the pitch whilst the third other base *7b* is in the centre of the pitch approximately two thirds of the way along the length of the pitch away from the batting end 3 of the pitch. The four bases are spaced apart on the apexes of a diamond shaped central area 8. The four bases are substantially equidistantly spaced from each other thereby forming a diamond of substantially symmetrical form as shown. Straight lines 9 connect the bases and a catchers zone 10 is located rearward of the batting base between the batting base 6 and the batting end 3. Two pitchers plates are marked on the centre line of the pitch. The first plate 11 will be used by advanced pitchers whilst the second plate 12 will be used by less advanced or junior pitchers.

Side walls 13 are erected around the perimeter of the pitch. These side walls 13 will preferably be approximately 5 meters high in the erected condition and will preferablY serve to retain a ball within the pitch during play. A ceiling (not shown) will be joined to the upper edges of the walls to be substantially continuous therewith and will be suspended above the pitch to thereby define a completely enclosed area in which a game may be played. Players will enter into the court so formed through a door or gap in the netting (not shown).

In the embodiment shown the side walls joined to the elongate edge of the pitch have been divided into five zones. Towards the batting edge of the pitch a first zone is defined which extends to the full height of the wall and is numbered 14. Second and third zones (numbered 15 and 16) are defined adjacent the first zone and are divided b a horizontal line 17. Fourth and fifth zones numbered 18 and 19 are divided by a horizontal line 20 at the end of each side wall remote from the batting end of the pitch.

The end wall 21 remote from the batting end of the pitch is also divided into five zones. Upper and lower edge zones are formed on each side of the said end wall 21 by horizontal lines 22.A central zone 23 is in the centre of and extends the full height of the said end wall 21. This central zone 23 will in use be a "home run" zone and a ball hit forward by a batsman standing over the batting base 6 which strikes the home run zone 23 without a bounce will be awarded maximum points in accordance with the skill required to execute that shot.

Walls 24 erected at the batsman's end of the pitch serve as a "foul" zone. The foul zone also includes both first zones 14 of the side walls. Said first zones 14 of the side walls terminate in vertical lines 25 which extend the full height of the side walls 13. These vertical lines 25 are somewhat rearward of the extension of the straight line passing through batting base 6 and first and third bases *7a* and *7c*.

The walls will be supported in their erected positions by ties (not shown) which hold the walls taut and vertical. The ties will connect the walls to an associated structure (not shown) erected above the court. The walls will preferably be made of a strong and resilient material such as plastic netting 13*a* which will be resistant to rupture by either a ball struck against the netting or by a person running into the netting.

Clearly it is not essential that the walls be made of netting at all and, for example, a solid or pre-fabricated wall structure could be constructed.

It is preferred that the entire court is located within an enclosed building such that the court may be used during inclement weather. For this purpose artificial lighting will be provided such that the court can be used at night as well as during the day. It will however also be possible to erect the apparatus out of doors using a suitable framed support structure or the like.

In use, players will be positioned around the pitch and a pitcher will stand on either pitching plate 11 or 12 and pitch a ball towards the batsman standing above the batting base 6. By striking the ball with the bat it will be caused to travel towards the walls and different points will be scored depending on the trajectory of the ball. It is envisaged that to duplicate the game of baseball the walls 24 behind the batsman and the zones 14 will be foul walls and points will not be scored or in fact will be subtracted should the ball leave the bat of the batsman and strike these walls. A ball struck in a forward direction towards end wall 21 will be in play and a hit resulting in the ball striking a wall without a bounce will be accorded points which correspond to the zone which the wall defines. The walls nearer the batsman will have lower scoring value than those remote from the batsman. It is envisaged that the most difficult shot will be to strike a ball so that it hits the home run zone 23 and this zone will therefore generally be accorded the highest scoring value. It is envisaged that the different zones will be differently coloured so that it will be a simple matter to correctly tabulate the scores of batsman.

The batsman after hitting a ball into play will run from the batting base to the first, second and third bases around the central area and back to the batting or home base in much the same way as conventional baseball. The batsman will also be got out in much the same way as conventional baseball. The lines 9 adjoining bases may have markings indicated at numeral 26 which serve as entry markers and exit markers. These markers will serve to assist in distinguishing the central portions of the lines form the ends thereof.

It will be appreciated that many different games may be played using the apparatus as described herein. Indeed, it will be appreciated that the pitch markings described herein are much the same as the pitch markings on conventional baseball fields. It is thus envisaged that the apparatus will be particularly adapted to baseball like games. However, it may be that a different configuration of bases may provide an enjoyable game and in this regard a base layout around a triangle having only three bases is specifically envisaged. The concept of having a plurality of bases spaced around a central area is considered to be an important aspect of the apparatus in that such an arrangement will enable different players to be spaced out around the interior of the court resulting in an improved game.

Many variations may be made to the described embodiment without departing from the spirit and ambit of the invention. In particular it will be appreciated that the configuration of the pitch may differ substantially from that described herein. Specifically envisaged is a slightly wider pitch and this regard it may be advantageous to have a substantially square court having a batting base located in one corner of the square.

Having now described my invention what I claim as new and desire to secure by Letters Patent is:

1. Apparatus for playing a baseball like game comprising an enclosed court which includes:

a pitch on which a baseball diamond is marked, said diamond markings comprising a home base, first, second and third bases, and straight lines connecting the bases;

an upstanding wall around the perimeter of the pitch formed of netting having a mesh configuration of sufficiently small size to retain a ball within said court, but sufficiently large size to enable a game played within the court to be viewed by spectators from without, said wall being formed by a plurality of straight wall sections extending around the pitch;

a ceiling joined to the upper regions of the walls to enclose the playing area;

said walls being demarcated into different zones, there being at least a home run zone on a wall section directly behind the second base when viewed form the batting base, and at least one horizontal line dividing a different section of said wall into upper and lower zones;

a plurality of pitching plates marked on said pitch and spaced apart on the line which joins the home and second bases;

said apparatus being sized and designed so as to be usable in the manner of a baseball game with a pitcher standing on said pitching plate pitching a ball towards a batter standing over said home base, said ball being struck by the batter towards said upstanding walls, and progress of said batter around said diamond being determined by the zone which said ball strikes after being so struck.

2. Apparatus according to claim 1 wherein said straight lines joining said bases are divided into a central portion and two end portions.

3. Apparatus according to claim 1 wherein the distance between adjacent bases is approximately 14 meters.

4. Apparatus according to claim 1 wherein said different zones are demarcated by different colored netting.

5. Apparatus for playing a baseball like game comprising an enclosed court which includes:

a pitch on which a baseball diamond is marked, said diamond markings comprising a home base, first, second and third bases, at least one pitching plate and straight lines connecting the bases;

an upstanding wall around the perimeter of the pitch formed of netting having a mesh configuration of sufficiently small size to retain a ball within said court, but sufficiently large size to enable a game played within the court to be viewed by spectators from without, said wall being formed by a plurality of straight wall sections extending around the pitch;

a ceiling joined to the upper region of the wall to enclose the playing area;

said wall being demarcated into different zones, there being at least a home run zone on a wall section directly behind the second base when viewed from the batting base, and at least one horizontal line dividing a different section of said wall into upper and lower zones;

said wall sections comprising two side wall sections which are parallel to each other on opposite sides of the pitch and parallel with an imaginary line joining home and second bases, an end wall section which is perpendicular to and joined to the side wall sections at the end of the pitch remote from the home base, and a pair of back wall sections behind said home base, said back wall sections being joined to the side wall sections adjacent the home base at an inclined angle of greater than 90° to form an end region on the pitch behind the home base of triangular configuration, said home run zone being defined in said end wall section, and said foul zone including at least both of the back wall sections;

said apparatus being sized and designed so as to be usable in the manner of a baseball game with a pitcher standing on said pitching plate pitching a ball towards a batter standing over said home base, said ball being struck by the batter towards said upstanding wall, and progress of said batter around said diamond being determined by the zone which said ball strikes after being so struck.

6. Apparatus according to claim 5 wherein a catchers zone is marked on the pitch in said triangular end region.

* * * * *